United States Patent [19]

Brooks et al.

[11] 4,067,663

[45] Jan. 10, 1978

[54] SEWAGE PUMP PRIMING SYSTEM

[75] Inventors: Richard J. Brooks; Frank O. Johnson, both of Seattle, Wash.

[73] Assignee: The Chemithon Corporation, Seattle, Wash.

[21] Appl. No.: 714,129

[22] Filed: Aug. 13, 1976

Related U.S. Application Data

[63] Continuation of Ser. No. 342,606, March 19, 1973, abandoned.

[51] Int. Cl.[2] ..... F04D 9/04; F04B 49/04

[52] U.S. Cl. ..... 417/199 A

[58] Field of Search ..... 417/199 A, 200, 40

[56] References Cited

U.S. PATENT DOCUMENTS

| | | | |
|---|---|---|---|
| 1,578,236 | 3/1926 | Labour | 415/53 T |
| 1,782,345 | 11/1930 | Haertjens | 417/199 A |
| 1,971,441 | 8/1934 | Broadhurst | 417/200 |
| 2,275,500 | 3/1942 | Broadhurst | 417/200 |
| 3,131,637 | 5/1964 | Jennings | 417/40 |
| 3,630,637 | 12/1971 | Repp | 417/200 |
| 3,836,285 | 9/1974 | Purtell | 417/279 |
| 3,868,198 | 2/1975 | Purtell | 417/279 |

FOREIGN PATENT DOCUMENTS

| | | | |
|---|---|---|---|
| 365,500 | 2/1922 | Germany | 417/199 A |
| 697,786 | 9/1940 | Germany | 417/199 A |

*Primary Examiner*—William L. Freeh

*Attorney, Agent, or Firm*—Merriam, Marshall & Bicknell

[57] ABSTRACT

A sewage pump priming system including a sewage pump disposed above a sump for holding sewage to force sewage from the sump through a sewage discharge conduit, a priming chamber receiving sewage from the sewage discharge conduit to be partially filled with sewage to a level above the sewage pump and the sewage discharge conduit, a vacuum pump communicating with the priming chamber for sucking sewage into the priming chamber to prime the sewage pump and a gas relief conduit providing a passage for gas above the level of sewage in the priming chamber to the sewage discharge conduit at a position downstream of the priming chamber such that the priming chamber is utilized to prime the sewage pump and to remove gas from the sewage pump priming system.

3 Claims, 4 Drawing Figures

FIG. 1
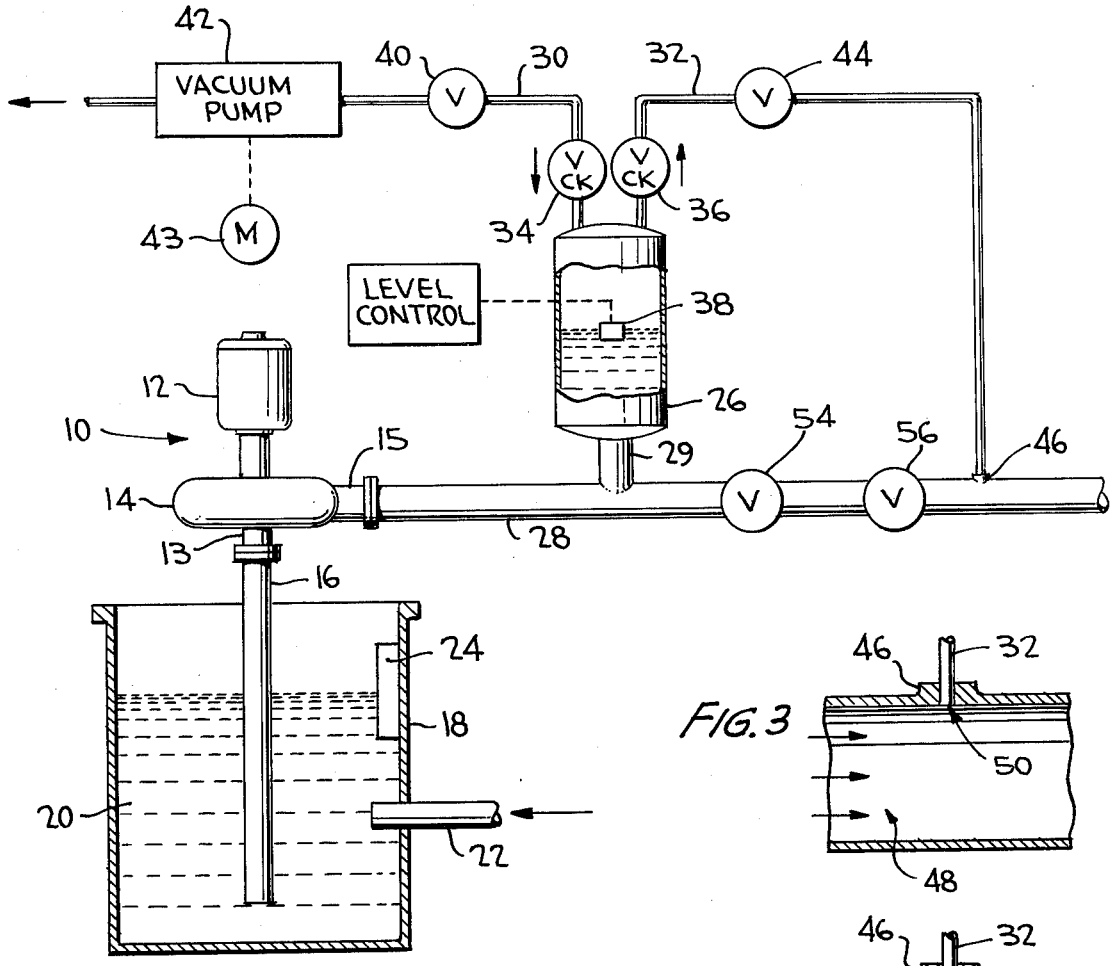
FIG. 3
FIG. 4
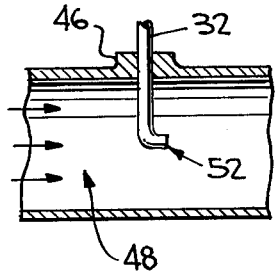
FIG. 2
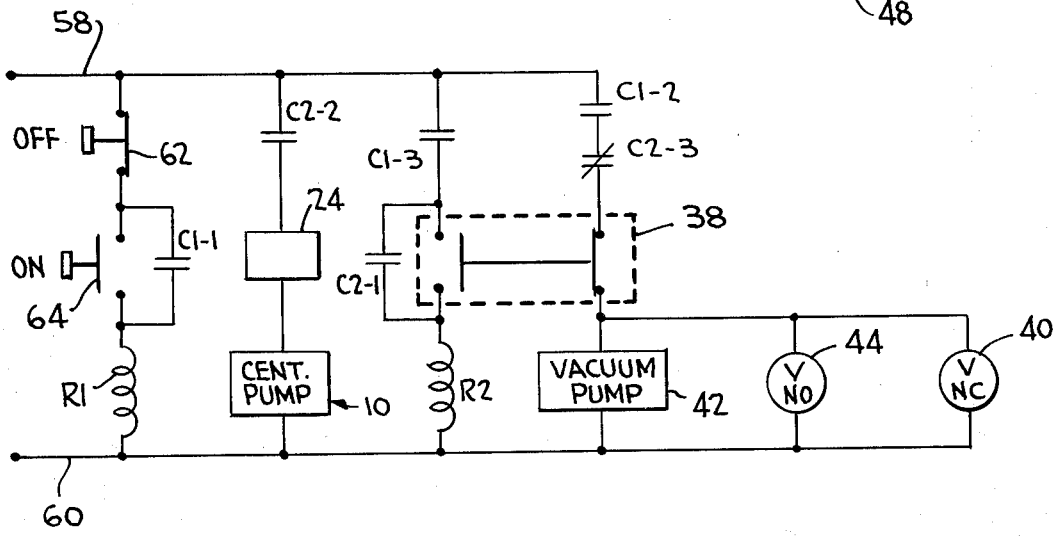

SEWAGE PUMP PRIMING SYSTEM

This is a continuation, of application Ser. No. 342,606, filed Mar. 19, 1973 now abandoned.

BACKGROUND OF THE INVENTION

1. Field of the Invention

The present invention relates to sewage pumping systems and, more particularly, to self-priming sewage pumping systems utilizing a sewage pump mounted above a reservoir storing sewage to be pumped.

2. Discussion of the Prior Art

It is well known in the art to use self-priming pumping systems for the movement of fluid sewage in that since such sewage pumping systems are primarily underground, it is incumbent that the sewage pump provides efficient operation for long periods of time without the need for frequent maintenance. In this regard, the requirement of low maintenance has required special adaptation of pumping systems for use in underground sewage treatment systems. The particular problems encountered in systems of this type include the complications resulting from the pumping of fluid material that contains certain amounts of sewage which can obstruct fluid flow passages, valves and other mechanical parts of the sewage pumping system. Further difficulties arise during the pumping of sewage due to its composition of liquid, semi-solid and solid matter in that decomposition and agitation of the sewage often causes the release of gases which accumulate in the pumping system.

U.S. Pat. No. 2,881,708 is exemplary of one type of prior art pumping system wherein a centrifugal pump does not run continuously, but operates intermittently, thereby requiring self-priming. This system utilizes a pumping apparatus including a combination of a vacuum pump and a centrifugal pump. The vacuum pump portion of the apparatus serves to bring water through an inlet tube into the centrifugal pump chamber and then into the delivery tube. The vacuum pump and centrifugal pump are driven by a single pump motor which turns a drive shaft connecting both the vacuum and centrifugal pumps. Therefore, in operation, when the pump is being primed, the centrifugal pump is in motion even though the pump chamber may be dry. Similarly, the vacuum pump is in constant operation when the centrifugal impellers are performing the fluid pumping operation. As a result of this design, the pumping apparatus, while providing self-priming, is subjected to undue wear and unnecessary simultaneous operation of the vacuum pump and centrifugal pump. Such wear is especially critical in the centrifugal portion of the pumping apparatus in that the centrifugal pump includes a mechanical seal to prevent leakage, which seal is designed to be lubricated by the fluid material when the system is in operation. Thus, during the priming operation, the dry condition of the seal can quickly destroy the seal and cause frequent maintenance to the pumping system. At the same time, the continuous operation of the vacuum pump while removing any air which accumulates in the system, causes an unnecessary drain on the pump motor and diminishes the efficiency of the pumping system.

Another self-priming pumping system known in the prior art which provides for the simultaneous evacuation of gas accumulating in the system is exemplified by U.S. Pat. No. 2,024,703. This system includes a motor which drives both a centrifugal pump and a vacuum pump at the same time and, consequently, has the disadvantages of operating the centrifugal impellers when the pump is dry and unnecessary operation of the vacuum pump continually, as mentioned above. It is noted, however, that while the system of U.S. Pat. No. 2,024,703 separates gas which accumulates in the centrifugal pump portion during operation, the conduit or chamber in which the separation of gas from the fluid takes place is merely a valve chamber of very small capacity thereby inhibiting effective removal of air from the system. This system utilizes a ball check valve to seal off the vacuum pump portion until air forms in the valve chamber allowing the valve to drop and release the air. The valve under such conditions is exposed to high pressures and is liable to damage by impact and blocking by solid or semi-solid material, such as sewage jammed against it.

The problems encountered in the previously described systems were addressed in U.S. Pat. No. 2,275,500, which discloses a system wherein the priming operation can be performed separately from the operation of the centrifugal pump; and, likewise, the centrifugal pump can be operated independently of the vacuum pump for priming operations. Accordingly, this system utilizes two separate motors, one for the vacuum portion and one for the centrifugal pump portion. The vacuum or priming pump is operated to draw liquid into the centrifugal pump portion and, when the desired liquid level is reached, shuts off and allows the centrifugal pump to begin operation. When gas accumulates in the system, the vacuum pump may be restarted and will then provide for the removal of the accumulated gas. Therefore, the inefficient operation and unnecessary wear on the self-priming pump system is avoided by selectively operating the priming and centrifugal pumps. Such independent operation, however, has the disadvantage of requiring frequent starting and stopping of the vacuum pumping system.

SUMMARY OF THE INVENTION

Accordingly, it is an object of the present invention to provide a sewage pump priming system overcoming the above-mentioned disadvantages of the prior art.

Another object of the present invention is to provide a self-priming sewage pumping system utilizing separately controlled sewage and vacuum pumps with the vacuum pump priming the sewage pump by communicating with the discharge side of the sewage pump to suck sewage from the sump through the sewage pump.

An additional object of the present invention is to remove gas from a sewage pumping system by accumulating the gas at the highest point in the system during pumping operation and delivering the gas to a point downstream of the discharge side of the sewage pump.

A further object of the present invention is to utilize a priming chamber in a sewage pumping system mounted above a sewage tank to be partially filled with sewage, the level of the sewage in the priming chamber being above the sewage pump and the main sewage discharge conduit such that gas accumulates in the priming chamber without displacement of liquid from the sewage pump volute or suction side.

The present invention has another object in the cooperation of a vacuum pump with a sewage pump to prime the sewage pump with the vacuum pump operation only to initially prime the sewage pump.

Some of the advantages of the sewage pump priming system of the present invention over the prior art are that the sewage pump priming system of the present invention is more reliable, highly maintenance free, compact in structure and can have major components thereof produced as an integral unit to facilitate shipping and installation.

The present invention is generally characterized in a sewage pump priming system including a sump for holding sewage, a sewage pump assembly disposed above the sump and having a suction side, a discharge side and an intake conduit extending within the sump to deliver sewage to the suction side, a sewage discharge conduit communicating with the discharge side of the sewage pump assembly, priming chamber communicating with the sewage discharge conduit to be partially filled with sewage to a level above the sewage pump assembly and the sewage discharge conduit, a vacuum pump communicating with the priming chamber for sucking sewage into the priming chamber to prime the sewage pump assembly, and a gas relief conduit communicating with the priming chamber at a position above the sewage level and with the sewage discharge conduit at a position downstream of the priming chamber to provide a passage for gas accumulated in the priming chamber during operation of the sewage pump assembly from the priming chamber to the sewage discharge conduit whereby the priming chamber is utilized to prime the sewage pump assembly and to remove gas from the sewage pump priming system.

Other objects and advantages of the present invention will become apparent from the following description of the preferred embodiment taken in conjunction with the accompanying drawings.

BRIEF DESCRIPTION OF THE DRAWINGS

FIG. 1 is a diagrammatic side elevation of the sewage pump priming system of the present invention.

FIG. 2 is a schematic diagram of the control system for the sewage pump priming system of FIG. 1.

FIG. 3 is an enlarged view of the junction of the gas discharge conduit with the fluid discharge conduit of the sewage pump priming system of FIG. 1.

FIG. 4 is an enlarged view of another type of junction of the gas discharge conduit with the fluid discharge conduit for use in the sewage pump priming system of FIG. 1.

DESCRIPTION OF THE PREFERRED EMBODIMENT

Referring now to the drawings and particularly to FIG. 1, a vertical shaft centrifugal sewage pump assembly is indicated generally at 10. The sewage pump assembly 10 includes a pump motor 12 and a pump impeller housing or volute 14 having a suction side or inlet 13 and a discharge side or outlet 15 with an intake conduit 16 depending from suction side 13 and a discharge conduit 28 communicating with discharge outlet 15. As shown in FIG. 1, pump volute 14, discharge outlet 15 and discharge conduit 28 are all horizontally disposed, and the tops of volute 14, discharge outlet 15 and discharge conduit 28 all lie at substantially the same elevation. Consistent with the foregoing, any pump capable of pumping sewage can be used with the present invention; and, accordingly, the internal structure of sewage pump 10 is not specifically described, such structure being well known.

The entire sewage pump assembly 10 is mounted above a sewage reservoir, such as a pump 18 for storing sewage 20. The sump is supplied with sewage through an inlet conduit 22. Also provided in the sump portion of the pumping system is a level sensing device 24 mounted on a side wall of the sump 18 for detecting the level of sewage in the sump.

A priming arrangement for the sewage pump assembly 10 includes a tank forming a priming chamber 26 mounted higher than the sewage pump 10 and discharge conduit 28. And communicating with the discharge side 15 of the sewage pump 10 through conduits 28 and 29. The priming chamber 26 is of sufficient capacity to enable the separation of any gas in the system during pumping operation without displacement of liquid from the pump volute or suction line. It is noted that the priming tank must cooperate with the discharge side of the sewage pump to achieve the objects and advantages of the present invention.

A vacuum discharge line 30 and a gas discharge line 32 communicate with the priming chamber 26 at the top of the tank in order to allow gas to be removed from the priming system. Accordingly, the discharge lines 30 and 32 are in the form of very small diameter conduits to handle gas only.

Liquid or solid sewage is prevented from entering the gas and vacuum discharge lines by check valves 34 and 36 disposed adjacent priming chamber 26, the check valves being of any suitable type such as float valves or the like. The liquid level in the priming tank is detected by a level sensing device 38, such as a float sensor or a photoelectric cell or the like, which normally controls the liquid level indirectly through the cooperation of a solenoid operated valve 40 in the vacuum discharge line 30 and a vacuum pump 42 communicating with the priming chamber through discharge line 30 under the control of valve 40.

Valve 40 has a normally closed state when the solenoid is deenergized, the solenoid being energized when the vacuum pump 42 is operated. A solenoid operated valve 44 is positioned in the gas discharge line 32 and held in a normally open state when the solenoid is deenergized to allow the discharge of gas accumulating in the priming chamber 26 during operation of the sewage pump 10. The valve 44 in the gas relief discharge line 32 functions to close off the relief line when the vacuum pump 42 is in operation and gas is being removed from the priming chamber through vacuum discharge line 30.

One particular advantage of the present invention is accomplished through the passage provided by the gas relief line 32 between the top of the priming chamber 26 and the sewage discharge conduit 28 in that the gas accumulating in the system is allowed to separate in the priming chamber from the liquid sewage being pumped since the priming chamber is situated at the highest point in the system. The gas discharge line, therefore, allows a passage for the escape of such gas from the system without disruption of the fluid flow. Accordingly, the gas relief line 32 communicates with the sewage discharge conduit 28 at a junction point 46 which is sufficiently downstream of the priming tank to allow a net pressure difference through the tank and relief line to effect gas removal. The removal of gas may be further assisted by the use of appropriate piping to provide an aspiration effect from the moving liquid flowing through the main sewage discharge conduit 28.

Two alternate designs are shown in FIGS. 3 and 4 with the gas relief line 32 in FIG. 3 opening into the main discharge conduit 28 flush with the inner wall of the discharge conduit 28. The flow of the sewage shown generally at 48 past the entry point 50 causes a general aspiration effect. As shown in FIG. 1, this discharge point may also be downstream from a backflow prevention valve 54 (e.g., check valve) or one way fluid flow valve 56 (e.g., gate valve) or combination thereof.

The design shown in FIG. 4 provides for the actual entry of the gas relief line 32 into the fluid flow 48 with the outlet 52 of the gas relief line being in the direction of the fluid flow. In this manner, a more pronounced aspiration effect can be achieved The gas relief apparatus of the sewage pump priming system in highly maintenance free and efficient since no liquid or solid material enters the gas and vacuum discharge lines and, therefore, the diameter of such conduits may be very small, contributing to the compactness of the system and providing other advantages in removing accumulated gas from the system.

To begin the pumping, the self-priming sewage pumping system is actuated by a switch which starts operation of the vacuum pump motor 43 and which, at the same time, closes the normally open valve 44 in the gas relief discharge line 32. As the vacuum pump motor operates, the vacuum created by vacuum pump 43 serves to create a suction through the priming chamber 26, discharge conduit 28, and centrifugal pump 10 to thereby bring sewage 20 from the sump 18 below the centrifugal pump up through the intake conduit 16, the centrifugal pump, the discharge conduit 28 and into the priming chamber. When the liquid in the priming chamber reaches a predetermined level, the centrifugal pump 10 is in a primed condition, level sensing device 38 is triggered which, in turn, closes the valve 40 between the vacuum pump and the priming chamber opens the gas relief valve 44 and turns off the vacuum pump motor 43. The centrifugal pump motor 12 can, thereafter, be started also in response to the liquid level reaching the predetermined point in the priming chamber.

The centrifugal pump motor drives the centrigual pump 10 which, having been primed by the action of the vacuum pump as described above, pumps the sewage from the sump 18 below to the discharge conduit 28 in a continuous manner. Such priming before actuation of the centrifugal pump provides a means for starting the centrifugal pump with fluid already drawn into it thereby providing an adequate seal and lubrication means for the centrifugal pump. Likewise, the centrifugal pump is never operated while dry, thereby eliminating the need for frequent maintenance to the seals and the impeller portion of the centrifugal pump.

During idle times, gas often accumulates in the sewage pumping system and must be removed therefrom to maintain efficient operation of the pump. The priming chamber 26 also provides this function of the sewage pumping system in that with the vacuum pump off, the corresponding opening of the gas relief valve 44 provides a gas relief means. By this action, the gas which accumulates in the system while the centrifugal pump is idle is allowed to escape during operation through the gas relief line 32 since any gas accumulating in the system will tend to rise to the highest point of the system and from the point of relative high pressure to a point of relative low pressure. In this instance, the priming tank 26 is positioned above the centrifugal pump 10 and above the discharge conduit 28, thus, constituting the highest point in the system. Accordingly, during operation, the centrifugal pump forces fluid into the discharge conduit which, in turn, forces fluid into the priming chamber as well as through the backflow prevention valve 54 such as a check valve and one-way flow valve 56 such as a gate valve in the discharge line. Any bas accumulating in the system will naturally accumulate in the priming chamber 26 where it is allowed to separate from the fluid being pumped. From this point, it is continuously drawn off through the gas discharge line 32 as a result of the net pressure difference between the priming tank and the downstream gas discharge line connection 46. It is, of course, understood that this net pressure difference is created in the gas discharge line 32 from the operation of the centrifugal pump 10 and fluid flow in the sewage discharge conduit 28. If, during such operation the fluid level in the priming chamber falls below the predetermined level indicated by the fluid sensing device 38, the vacuum pump is reactuated with the corresponding closing of the gas discharge line 32 by operation of the valve 44 therein. Correspondingly, it is noted that the priming tank contains float check valves 34 and 36 for the gas discharge lines and the vacuum line so that no fluid will escape into such gas lines. Thus, it is noted that these lines may be of extremely small diameter in comparison to the fluid conduits 16 and 28 which must be large enough to allow the passage of sewage material without clogging.

To prevent any backflow of fluid in the system when the centrifugal pump ceases operation, a one way check valve 56 is provided in the discharge conduit 28 downstream from the priming chamber and upstream from the point 46 at which the gas relief line cooperates with the discharge conduit.

The sewage pumping system can utilize more than one centrifugal pump and priming system in order to provide redundant back-up. The pumps do not operate at the same time; and hence, one is utilized as a back-up system for the primary pumping system with each pump being, preferably, supplied with a separate priming system. Thus, if one pump loses its prime, or if the controls cease to operate, the system enables the back-up pump and priming system to take over.

A control circuit for implementing operation of the sewage pump priming system as described above is illustrated in FIG. 2 wherein a conventional source of electricity is supplied across leads 58 and 60. The control circuit includes a normally closed off switch 62 and a normally open on switch 64 such that in order to commence operation of the sewage pump priming system, momentary operation of on switch 64 energizes a relay R1 to pull in normally open contacte C1-1 to hold the relay winding R1 in an energized state. With relay winding R1 energized, normally open contacts C1-2 will be closed to energize vacumm pump 42 and the solenoids of valves 40 and 44 such that normally open valve 44 is closed and normally closed valve 40 is open, it being appreciated that the level of sewage in priming chamber 28 will not be up to the predetermined level established by sensor 38. The sensor 38 essentially provides double-throw switching action such that the vacuum pump 42 and the valves 40 and 44 can be energized when the sewage is below the predetermined level while a relay winding R2 remains unenergized even though normally open contacts Cl-3 are closed.

With the vacuum pump energized, suction is created to draw sewage 20 through the sewage pump 10 and into the priming chamber 26 while the centrifugal pump 10 is deenergized due to the deenergized state of relay winding R2 which causes normally open contacts C2-2 to disconnect the motor 12 for the sewage pump 10. Once the sewage in priming chamber 26 reaches the predetermined level, sensor 38 will be actuated to energize relay winding R2 and deenergize vacuum pump 42 and the solenoids controlling valves 40 and 44. Energization of relay winding R2 closes normally open contacts C2-2 to energize sewage pump 10 if the level of sewage within sump 18 is above a predetermined lvel established by sensor 24. Thus, the centrifugal sewage pump 10 is operated to pump fluid from the sump 18 through the sewage discharge conduit 28 while the vacuum pump 42 is inoperative. Valve 40 will be in its normally closed state at this time and valve 44 will be open such that gas accumulated above the sewage level in the priming chamber 26 can escape through relief line 32 to the junction 46 with sewage discharge conduit 28 downstream of priming chamber 26.

With the energization of relay winding R2 and initiation of operation of the sewage pump, normally closed contacts C2-3 is opened and remains so until relay winding R2 is deenergized. This prevents reactivation of vacuum pump 42 until the pumping operation has ceased and the sewage pump again requires priming. Thus, once the system has been primed by operation of vacuum pump 42, the fluid flow from the operation of the sewage pump causes gas to be efficiently removed from the system through the gas discharge line 32. No further operation of the vacuum pump is, therefore, desired or necessary. When it is desired to stop operation of the sewage pumping system, off button 62 is momentarily depressed to deenergize control relays R1 and R2 as well as the active components of the system.

The control circuit shown in FIG. 2 is merely exemplary of various types of control circuits that could be utilized to implement the operation of the sewage pump priming system of the present invention as set forth above; accordingly, the control circuitry may take any form to carry out the function set forth above utilizing any type of control components, such as solid state devices, electronic devices, fluid devices, or the like. Similarly, the level sensors used in the priming chamber and the sump may be of any conventional construction, such as the mechanical float or photoelectric cell type or any other level sensors suitable for determining liquid level. Furthermore, additional level sensors may be utilized in the impeller housing, suction side or discharge side of the pump in addition to the priming chamber and sump level sensors or as a substitute for the level sensor in the sump. To this end, it is noted that the primary function provided by the level sensing devices are to assure operation of the sewage pump only when sufficiently filled with sewage so that the pump seals are continuously lubricated; that is, the sewage pump should not be permitted to operate when dry and the level sensors, disposed in the sump and/or in the sewage pump itself, assure continuous fluid pumping operation.

While the present invention has been described primarily with the pumping of sewage by a centrifugal pump, it is noted that any pump suitable for such use may be utilized. It is, however, centrifugal pumps which are desirably used in sewage pumping systems since the nature of the pumping operation requires a pump capable of efficiently handling solid-containing liquid sewage. Vertical shaft centrifugal pumps mounted above the sewage sump are particularly effective for use with the sewage system of the present invention in that they can be operated without maintenance over a long period of time.

Inasmuch as the present invention is subject to many variations, modifications and changes in detail, it is intended that all subject matter described above or shown in the accompanying drawings be interpreted as illustrative and not in a limiting sense.

What is claimed is:

1. A system for pumping sewage from a sump containing solid, liquid and semi-liquid gas-evolving sewage, said system comprising:

a centrifugal pump actuable after it has been primed, said centrifugal pump having a pump volute lying in a horizontal disposition, an inlet at the bottom of said volute, and a discharge outlet extending horizontally from said horizontally disposed pump volute;

said pump being located above said sump;

an intake conduit communicating with said inlet and extending downwardly therefrom for positioning in said sewage-containing sump;

a discharge conduit extending downstream from said discharge outlet of the pump;

the tops of said pump volute and said discharge outlet lying at substantially the same elevation;

valve means on said discharge conduit for permitting fluid flow in a downstream direction only;

a vertically disposed priming chamber communicating with said discharge conduit at a location between said centrifugal pump and said valve means;

the top of said discharge conduit, between said discharge outlet and said priming chamber, being at least about as high as the top of said discharge outlet;

said priming chamber being disposed above said pump volute and at least that part of said discharge conduit between said pump and said valve means;

said system comprising means, including the capacity of said priming chamber, for accommodating in said chamber gas separating from the sewage in said system without displacing liquid from said centrifugal pump;

and means operable to pump gas out of the upper portion of said vertically disposed priming chamber at a predetermined time to reduce the pressure therein sufficiently to draw liquid from said sump, through said centrifugal pump and into said priming chamber, to prime the pump while it is inoperative.

2. A sewage pumping system as recited in claim 1 and comprising:

means, including said centrifugal pump, said discharge conduit and said location of said priming chamber, for forcing liquid into the priming chamber during operation of the centrifugal pump;

and means, separate and discrete from said means operable to pump gas, for removing gas from the upper portion of said priming chamber in response to operation of said centrifugal pump without involving said means operable to pump gas.

3. In a sewage pumping system as recited in claim 2:

said gas-removing means comprising conduit means for conducting gas from the upper portion of said priming chamber to said discharge conduit at a location thereon downstream of said valve means on the discharge conduit, said location being sufficiently downstream of said priming chamber so that the pressure at said location during operation of said centrifugal pump is less than the pressure in the upper portion of said priming chamber;

valve means for preventing the flow of liquid from said priming chamber into said gas-conducting conduit means;

and valve means for closing said gas-conducting conduit when said gas pumping means is operating.

* * * * *